US006058895A

United States Patent [19]

Hermsen

[11] Patent Number: 6,058,895

[45] Date of Patent: May 9, 2000

[54] MEANS FOR THE ACTUATION OF VALVES ON A RECIPROCATING ENGINE WITH A VARIABLE VALVE LIFT, IN PARTICULAR A RECIPROCATING INTERNAL COMBUSTION ENGINE

[75] Inventor: Franz-Gerd Hermsen, Wuerselen, Germany

[73] Assignee: FEV Motorentechnik GmbH & Co., Aachen, Germany

[21] Appl. No.: 08/894,028

[22] PCT Filed: Nov. 29, 1996

[86] PCT No.: PCT/EP96/05294

§ 371 Date: Nov. 12, 1997

§ 102(e) Date: Nov. 12, 1997

[87] PCT Pub. No.: WO97/21910

PCT Pub. Date: Jun. 19, 1997

[30] Foreign Application Priority Data

Dec. 11, 1995 [DE] Germany ..... 295 19 593 U
Jun. 11, 1996 [DE] Germany ..... 196 23 257

[51] Int. Cl.[7] ..... F01L 13/00

[52] U.S. Cl. ..... 123/90.16; 123/90.39; 123/198 F

[58] Field of Search ..... 123/90.15, 90.16, 123/90.39, 90.44, 90.45, 198 F

[56] References Cited

U.S. PATENT DOCUMENTS

| | | | |
|---|---|---|---|
| 5,113,813 | 5/1992 | Rosa | 123/90.16 |
| 5,544,628 | 8/1996 | Voigt | 123/90.16 |
| 5,609,133 | 3/1997 | Hakansson | 123/90.16 |

FOREIGN PATENT DOCUMENTS

| | | |
|---|---|---|
| 2039975 | 2/1972 | Germany . |
| 63309707 | 12/1988 | Japan . |
| 5098919 | 4/1993 | Japan . |
| 8158828 | 6/1996 | Japan . |
| 424797 | 2/1935 | United Kingdom . |

*Primary Examiner*—Weilun Lo
*Attorney, Agent, or Firm*—Venable; George H. Spencer; Ashley J. Wells

[57] ABSTRACT

A device for actuating valves of a reciprocating engine, such as a reciprocating internal combustion engine, includes a lever arrangement having a cam lever and having an adjustment device for adjusting an idle stroke in relation to the valves; a control shaft on which the cam lever is positioned and which can be turned back and forth relative to the lever arrangement so that the adjustment device is actuated; at least one camshaft each having a respective cam which acts upon the lever arrangement to actuate at least one valve, wherein the cam lever is positioned pivotally on the control shaft, in contact with at least one cam on one side thereof, and in contact with the at least one valve to be actuated on another side thereof, wherein the control shaft has a pressure medium channel for supplying a fluid medium defined therein, wherein the control shaft has a cross bore defined therein in communication with the pressure medium channel, and wherein the adjustment device is an hydraulic adjustment device including a pressure cylinder provided in the lever arrangement, a transmission element that moves as a piston within the pressure cylinder and acts on the valve, and a feed channel in communication with the pressure cylinder at one end thereof and connectable via the cross bore in the control shaft with the pressure medium channel by turning the control shaft.

11 Claims, 6 Drawing Sheets

MEANS FOR THE ACTUATION OF VALVES ON A RECIPROCATING ENGINE WITH A VARIABLE VALVE LIFT, IN PARTICULAR A RECIPROCATING INTERNAL COMBUSTION ENGINE

BACKGROUND OF THE INVENTION

FIELD OF THE INVENTION

For modern reciprocating internal combustion engines with conventional valve drives for actuating the valves via a camshaft and a corresponding lever arrangement, it is desirable to change the valve lift in accordance with the values predetermined in a performance diagram in order to optimize the combustion.

SUMMARY OF THE INVENTION

In order to solve this problem, a means for actuating valves on a reciprocating internal combustion engine is suggested in accordance with the invention, which comprises at least one camshaft, wherein respectively one cam acts upon a lever arrangement actuating at least one valve and having two pivotally mounted levers, of which one lever is connected to the cam and the other lever is connected to the valve to be actuated, wherein the separate levers are connected to each other via an adjustment means, which can be used to adjust an idle stroke between cam lever and valve lever. This makes it possible to vary the start and the end of the valve lift as well as the extent of the valve lift itself through a specific change in the idle stroke position relative to each other of the two levers. Depending on the operation, this can be done, for example, in dependence on a predetermined performance diagram for an electronic motor control device. The lever arrangement can be designed as valve rocker as well as cam lever arrangement.

The embodiment of the invention provides that the cam lever and the valve lever are positioned on a control shaft, which is positioned such that it can be turned back and forth relative to the lever arrangement, is designed to actuate the adjustment means and is connected to an actuator that can be triggered. This arrangement has the advantage that the positioning of the lever arrangement simultaneously functions as device for actuating the adjustment means, wherein the necessary actuator can be designed to be activated mechanically, hydraulically or even electromagnetically.

In this connection, a useful embodiment provides that the cam lever is connected to a spring-mounted support element that is effective against the cam. The arrangement of a spring-mounted support element on the one hand has the effect that the cam lever always fits against the cam on the cam side, so that with a reduced valve lift that is predetermined by the adjustment means, the cam lever "breathes" over a section of the lift predetermined by the cam geometry, meaning that it has no effect on the valve lever.

For another embodiment of the invention, it is provided that the adjustment means is formed by a pressure cylinder arranged in one of the levers, and by a transmission element moving as a piston within the pressure cylinder, which supports itself with its free end on the other lever, and that the pressure cylinder has a bypass channel, which can be connected via a cross bore in the control shaft to a pressure medium channel in the control shaft by turning the control shaft. This design for the adjustment means has the advantage that the contact between the transmission element and the lever that fits against it is always ensured via the pressure medium. In the most simple form, the idle stroke can be predetermined through the position of the cross bore in the control shaft with respect to the feed channel for the pressure cylinder. With a corresponding position of the cross bore, the relative motion of the lever comprising the pressure cylinder closes the connection between cross bore and feed channel with the slider, so that the residual volume of the incompressible pressure medium, together with the transmission element, acts like a rigid body, thereby transmitting the forces between cam and valve spring in full. It is possible in this case as well to keep the cam lever in continuous contact with the cam via[]he pull-back spring on the cam lever, so that the cam lever "breathe" over a corresponding portion of the total lift, depending on the position of the cross bore to the feed channel of the pressure cylinder, until the full force transmission and thus the valve lift predetermined by the position of the control shaft can occur.

Instead of embodying the transition region between the cross bore and the feed channel as a slide valve, it is useful for another embodiment of the invention to arrange a valve in the feed channel. This valve can be designed as a return valve or even a force-controlled valve, depending on the structural design. In this case, the forced control can be exerted via cams on the control shaft or even via an independent, controllable adjustment drive, e.g. a magnetic drive, depending on the structural design.

A further embodiment of the invention provides that the pressure cylinder has a feed channel and a discharge channel and that a valve is arranged in the feed channel as well as in discharge channel. This permits a directed feeding of the pressure medium to the pressure cylinder.

For one practical embodiment of the invention, it is provided that the adjustment means is formed by a spline, positioned in one of the levers and by a transmission element that is supported on the one hand on the spline and, on the other hand, on the other lever and that the control shaft is provided with a radial cam that acts upon the spline. The possible adjustment of the idle stroke is predetermined in this case on the one hand by the profile of the radial cam on the control shaft and on the other hand by the slant and/or profile of the spline. It is useful in this case if the spline is stressed with a pull-back spring, so that it is pushed against the radial cam on the control shaft, and the possible relative motion between cam lever and valve lever accordingly takes place in the region of the transmission element. The transmission element here is usefully designed as damping element to avoid an abrupt force introduction between cam lever and valve lever. The transmission element itself can be configured as a piston-cylinder element, which can be admitted with a pressure medium, e.g. via a choke line.

BRIEF DESCRIPTION OF THE DRAWINGS

The invention is explained in more detail with the aid of diagrammatic drawings of exemplary embodiments. Shown are in.

DESCRIPTION OF THE PREFERRED EMBODIMENTS

Figure 1:
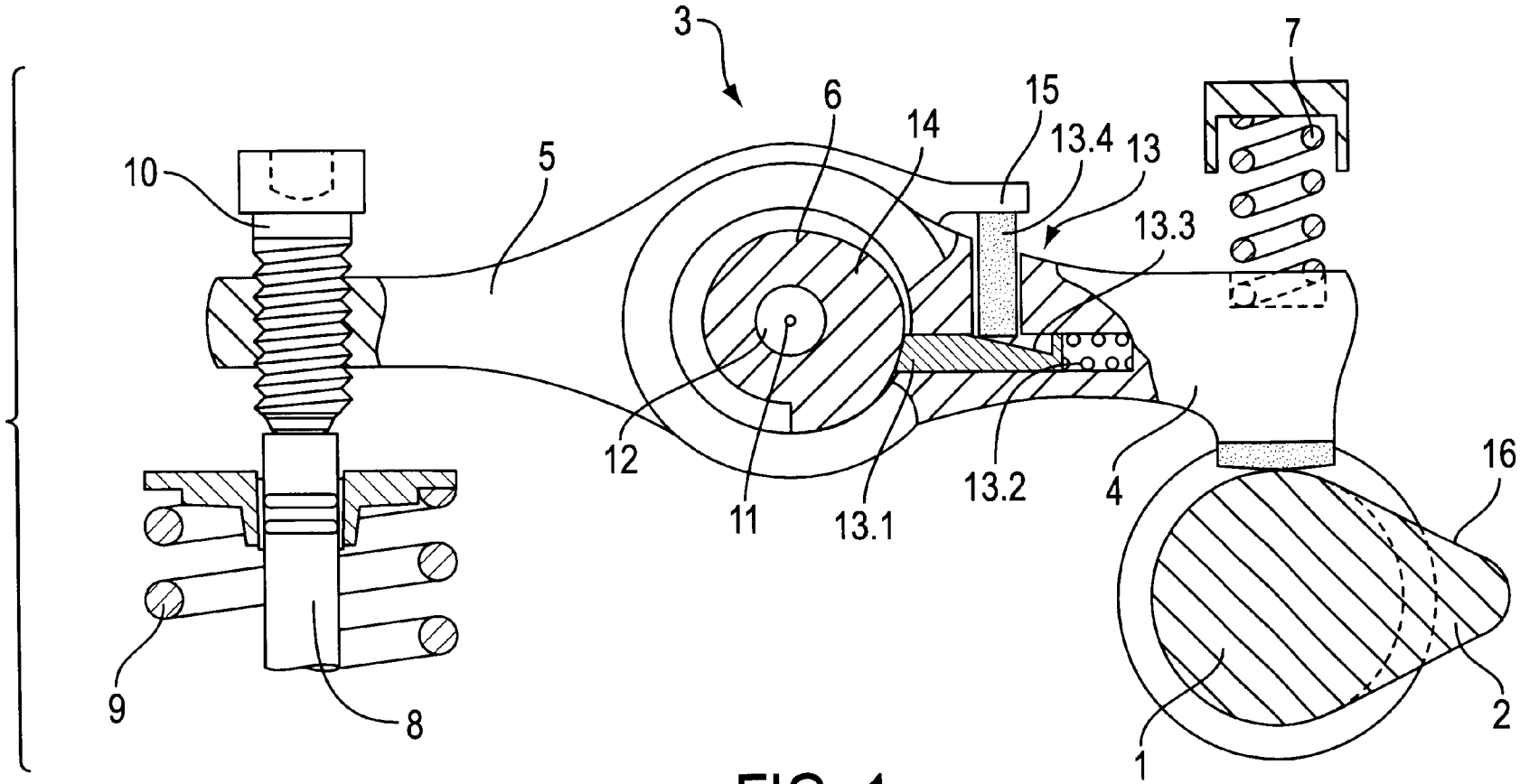
FIG. 1 A valve rocker arrangement with mechanical adjustment of the idle stroke.

The means shown in FIG. 1 for actuating a valve comprises a cam shaft 1 with a radial cam 2. The radial cam 2 acts upon a lever arrangement 3 with two separate levers, meaning a cam lever 4 and a valve lever 5. The two levers 4 and 5 are positioned pivoting on a control shaft 6, which is positioned such that it can be turned relative to the two levers 4 and 5 and which is connected to an actuator that is not shown in detail here.

The cam lever 4 supports itself on the guide surface of cam 2 and is kept in a contacting position with the guide surface of cam 2 by a support spring 7.

The valve lever 5 supports itself on the shaft 8 of the valve to be actuated, which is kept in the closed position via the valve spring 9. The valve play can be adjusted via an adjustment screw 10 in the valve lever 5.

The cam lever 4 and the valve lever 5 are positioned separately and such that they can pivot relative to each other on the control shaft 6, so that an idle stroke can be adjusted between the two separate levers 4 and 5. They are lubricated via a pressure medium channel 12 in the control shaft 6.

In order to be able to transmit the adjustment force from the cam 2 to the valve 8, an adjustment means 13 is arranged between the two levers 4 and 5, which is designed on the one hand to transmit the force and, on the other hand, can be used to change the idle stroke between the two levers 4 and 5. The adjustment means 13 essentially comprises a spline 13.1, which is pushed by a pull-back spring 13.2 against a control cam face 14 on the control shaft 6. A transmission element 13.4 supports itself with one end on the spline surface 13.3 of the spline 13.1, while the other end fits against an extension 15 of the valve lever 5. By turning the camshaft 6, the spline 13.1 can be displaced accordingly via the control cam face 14, so that the support distance between spline surface 13.3 and the supporting extension 15 on valve lever 5 also changes correspondingly.

The starting position for the valve lever 5 is predetermined by the closing position that is forced through the strong valve spring 9 and can be changed only within narrow margins by way of the adjustment screw 10.

The cam lever 4 is pushed by the support spring 7 against the guide surface 16 of cam 2. The illustration at hand shows the complete arrangement for the closing position of the valve.

If, as shown in the drawing, the spline 13.1 is moved to its end position via the control cam face 14 of control shaft 6, then both ends of the transmission element 13.4 rest without play against the spline surface 13.3 as well as the respective counter surface on the extension 15 of valve lever 5. When turning the cam shaft 1, the valve is opened via the cam 2 with full lift, corresponding to the predetermined guide surface 16, and is closed again.

If the spline 13.1 is pulled back through a corresponding twisting of the control shaft 6 (in clockwise direction in the drawing), then the valve lever 5 remains in the predetermined position while the valve is closed, whereas the cam lever 4 continues to make contact with the guide surface 16 of cam 2 via the support spring 7. If the cam lever 4 then impacts with the guide surface 16 of the cam 2, it is initially pivoted only against the force of the support spring 7, until the force transmission between the two separate levers becomes effective via the support element 13.4, and the valve lever 5 opens the valve against the force of the valve spring 9. This achieves that the valve opens up later and with less lift, corresponding to the position of the spline 13.1, and correspondingly also closes earlier since the idle stroke between the two levers 4 and 5, meaning the angle between the levers 4 and 5 that is predetermined by the position of spline 13.1 is defined by the contact without play of support element 13.4 with the spline surface 13.3 on the one hand and the corresponding counter surface on the extension 15 on the other hand. The idle stroke can be adjusted during the operation via the control shaft 6, in dependence on the operating conditions of the motor, e.g. based on a performance characteristic for a motor control.

In order to avoid a free play, the support element 13.4 itself can be provided with a support spring that is not shown in detail here and which ensures a contact without play on the spline surface 13.3 and the counter surface on the extension 15. When adjusting the maximum lift, as shown in the drawing, the spring is compressed far enough so that the support element 13.4 makes contact with both ends. If the minimum lift is adjusted by pulling back the spline 13.1, then the transmission element 13.4 makes contact with one end with the corresponding surface, but only via the spring, so that the cam lever 4 can be pivoted relative to the valve lever 5, and the force transmission does not occur until the spring is compressed completely and the valve is opened.

It is practical if the transmission element is designed as damping element, which can be achieved, for example, with a correspondingly designed piston-cylinder unit with pull-back spring, wherein the embodiment of this piston-cylinder unit can be a design copying that of a hydraulic valve-play compensation. The compressibility of the support element 13.4 is ensured in this case as well if a valve lift that deviates from the maximum lift is adjusted.

Figure 2:
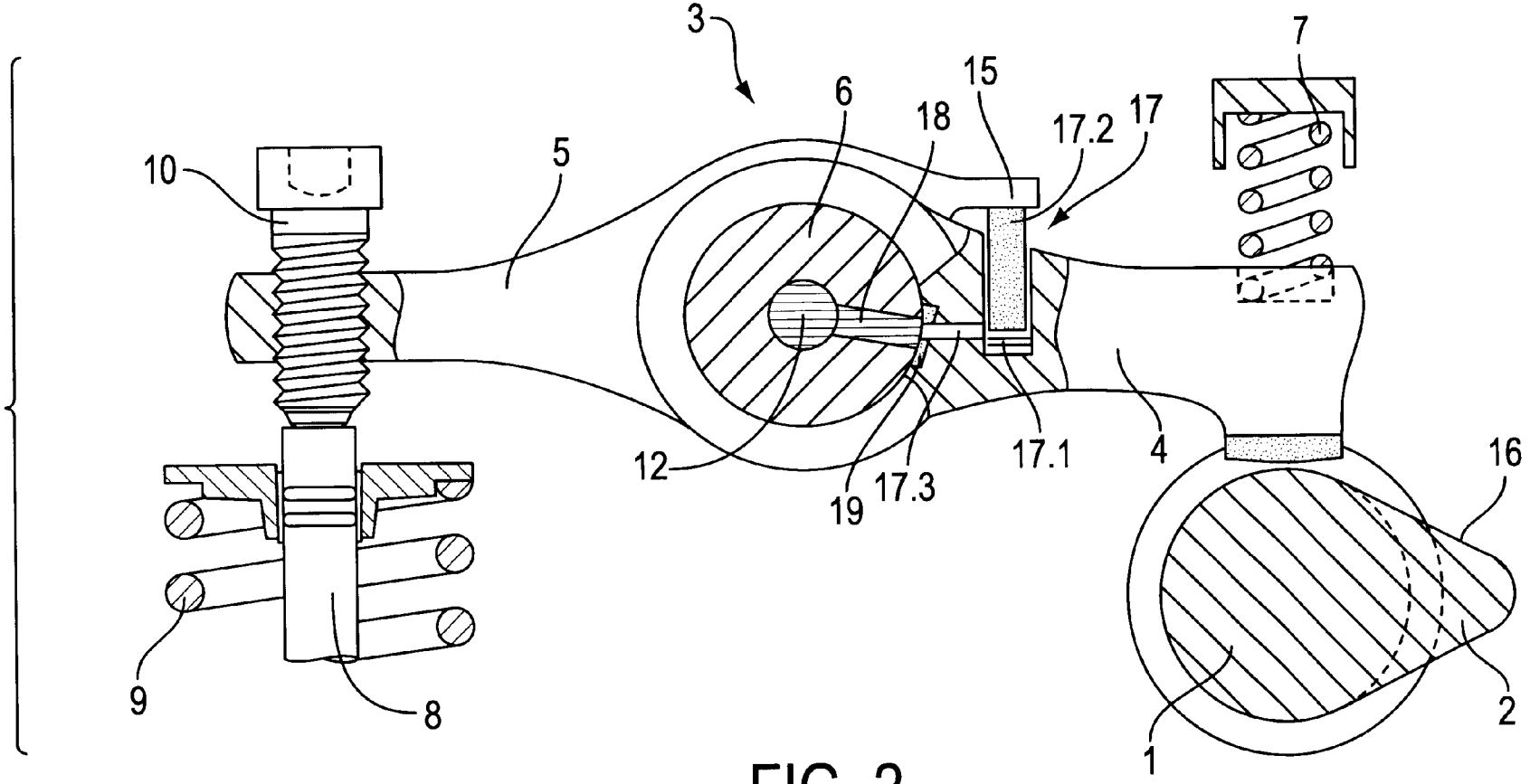
FIG. 2 A valve rocker arrangement with hydraulic adjustment of the idle stroke.

FIG. 2 shows as valve actuation means with a design that essentially corresponds to the design for the valve actuation means according to FIG. 1, so that the same components are provided with the same reference numbers.

However, this embodiment is provided with a hydraulic adjustment means 17 for changing the idle stroke between cam lever 4 and valve lever 5.

The adjustment means 17 is essentially formed by a pressure cylinder 17.1, arranged in one of the two levers and in this case in the cam lever 4, as well as a therein moving transmission element 17.2, designed as a piston, the free end of which fits against the extension 15 of valve lever 5 and the other end of which can support itself on a pull-back spring in the pressure cylinder.

The pressure cylinder 17.1 is connected via a feed channel 17.3 with a cross bore 18 in the control shaft 6, which in turn is connected to the pressure medium channel 12 that supplies the lubricant. The mouth for the feed channel 17.3 in the transition region to the cross bore 18 is provided with a corresponding seal 19. If the cam lever 4 impacts with the guide surface 16 of cam 2 during the turning of the camshaft 1, then the cam lever 4 is initially pivoted without obstruction since the closing force of the closing spring 9 is high enough so that the pressure fluid from the pressure cylinder 17.1 can be pushed back into the pressure medium channel 12 by way of the feed channel 17.3 and the cross bore 18. This return flow of the pressure medium continues until the mouth of the feed channel is no longer connected to the cross bore 18, but is covered by the exterior surface of the control shaft 6. Only then can a corresponding adjustment force be transferred via the transmission element 17.2, designed as a piston, to the valve lever 5, and the valve can be opened. This process is reversed during the closing phase, meaning after the valve has reached its closed position, the cam lever 4 tracks the guide surface 16 of cam 2 due to the force action from the support spring 7, wherein the feed channel 17.3 is then once more connected via cross bore 18 with the pressure medium channel 12 and pressure medium can accordingly be forced again into the pressure cylinder 17.1.

The transmission element 17.2 in this case is held in the contact position on extension 15 by the pressure from the pressure medium and/or a spring. The idle stroke measure between cam lever 4 and valve lever 5 can be changed correspondingly through a respective turning of the control shaft 6 and thus a respective adjustment of the degree of overlap for the opening of feed channel 17.3 and the cross bore 18. It makes sense if the through bore of sealing disc 19 is a metered bore and its diameter is adjusted to the desired quantities of flow and/or the flow-through speeds. The cross bore 18 in connection with the through bore in the sealing disc 19 or the mouth of the feed channel 17.3 here functions as adjustment slide.

Figure 3:
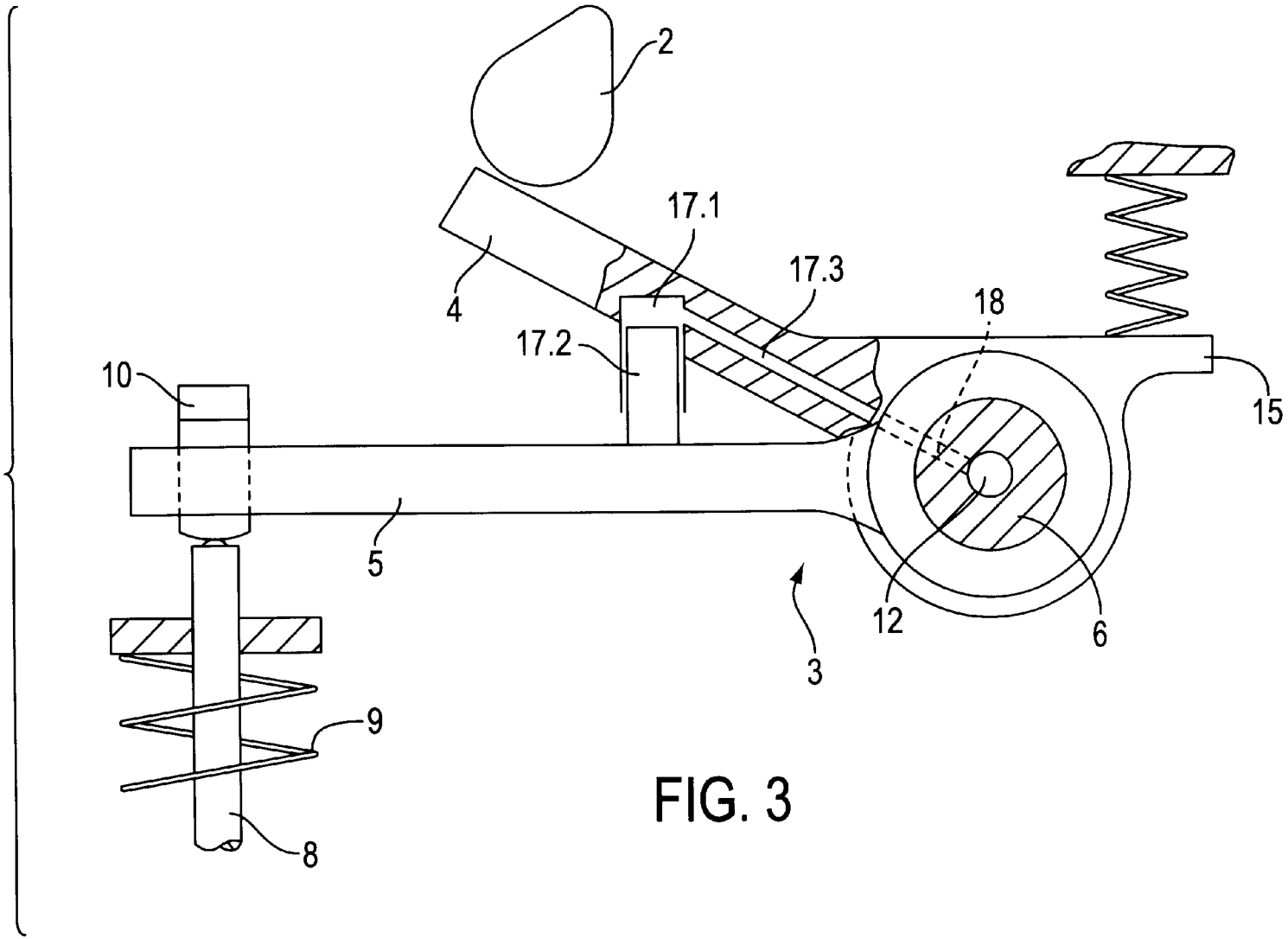
FIG. 3 A two-part cam lever arrangement with hydraulic idle stroke adjustment.

The above-described valve actuating means in the form of a valve rocker with two parts, can also be transferred to valve actuation means in the form of so-called cam levers. This is shown in FIG. 3 in a diagrammatic drawing for a two-part cam lever arrangement with hydraulic adjustment means. The arrangement corresponds to the arrangement according to FIG. 2 with respect to its operation and essentially also the design. It is only the spatial coordination of the cam shaft 1 to the lever arrangement 3 and correspondingly the assignment of the cam lever 4 to the valve lever 5, which is changed in accordance with the change in the assignment geometry. Identical structural components are provided with the same reference numbers, so that it is possible to point to the description for FIG. 2.

It is useful if a damper is assigned to the valve, which acts upon the valve shaft 8 or the lever 5, for example, and which softens the valve impact on the valve seat. This is particularly important for an operation with high rotational speed and reduced valve lift.

Figure 4:
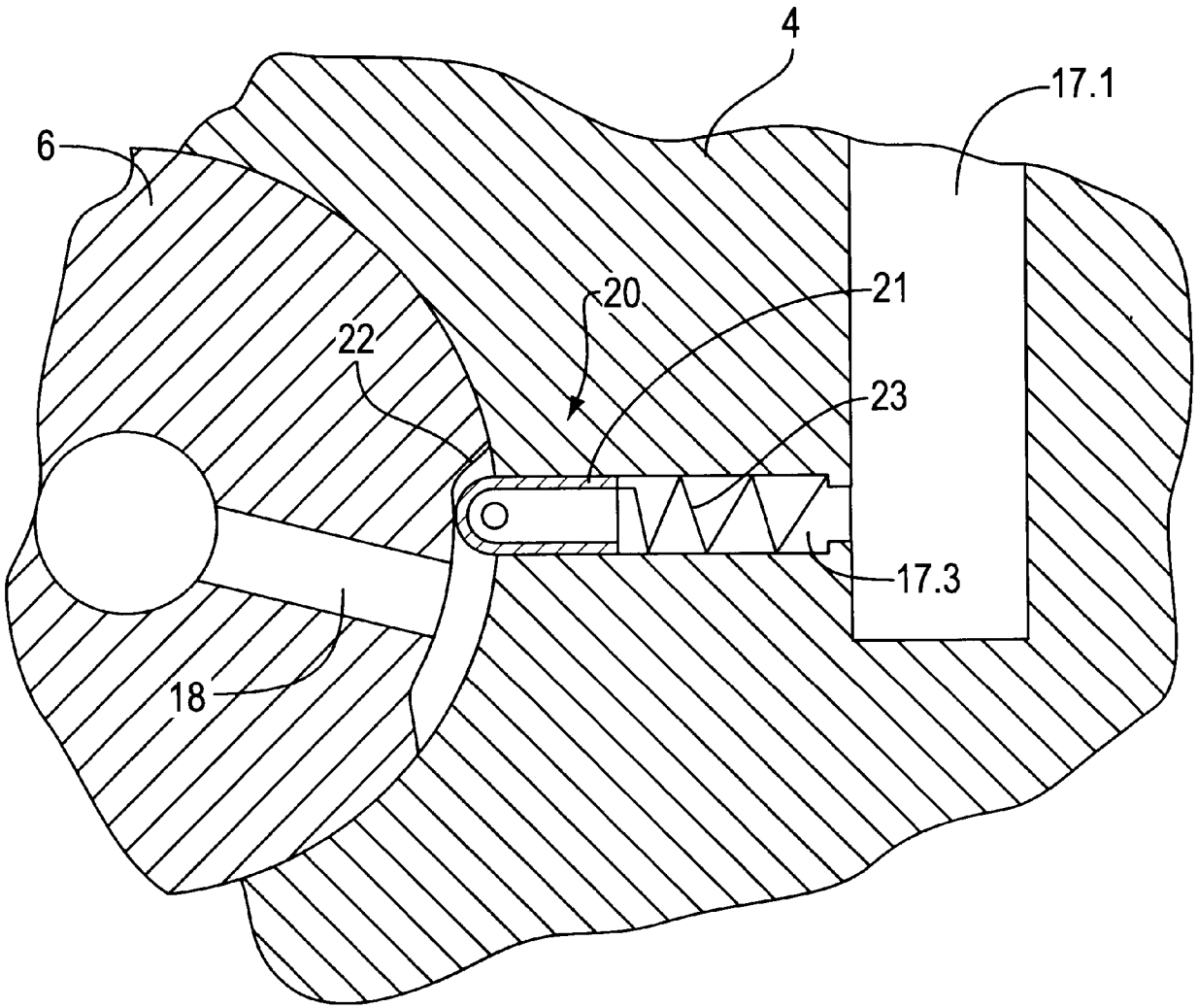
FIG. 4 The embodiment according to FIG. 2 with control valve, on a larger scale.

FIG. 4 shows an enlarged section of the transition region between the cross bore 18, the control shaft 6 and the feed channel 17.3 in the cam lever 4. While the transition region for the embodiment according to FIG. 2 is designed as slide valve owing to the arrangement of the sealing disc 19, the embodiment according to FIG. 4 has a valve 20 in this region, for which the valve body 21 can be displaced counter to the force of a pull-back spring 23 in the feed channel 17.3 by way of a control cam face 22 on control shaft 6, and can be moved from the opened position shown here to a closed position. Otherwise, the operation of this arrangement corresponds to the operation described on the basis of FIG. 2.

Figure 5:
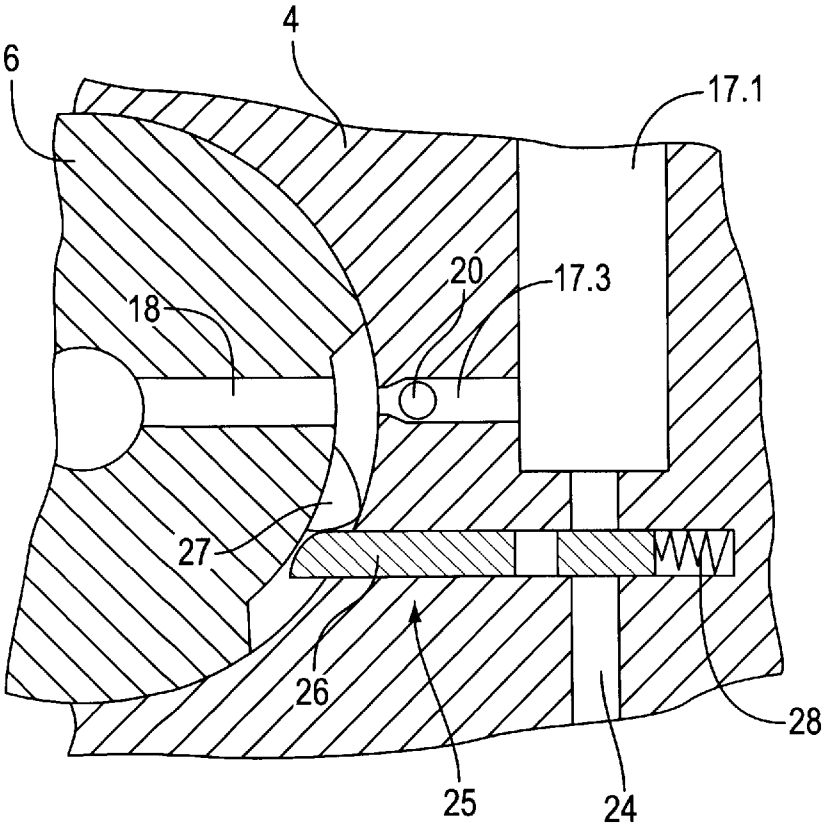
FIG. 5 A modification of the embodiment according to FIG. 4.

For the embodiment shown in FIG. 5, which is also on a larger scale, a valve 20 in the form of a check valve is arranged in the feed channel 17.3 of cam lever 4, which opens in the filling direction for pressure cylinder 17.1. The pressure cylinder 17.1 for this embodiment is provided with a discharge channel 24, which can be opened via a force-controlled valve 25. The force-controlled valve 25 in the embodiment shown here has a valve body 26, which can be adjusted counter to the force of a pull-back spring 28 via a cam 27 on the control shaft 6, so that the valve 25 can be actuated via a corresponding turning of the control shaft 6, and a purposeful discharge of the pressure medium from the pressure cylinder 17.1 can thus be effected via the discharge channel 24.

Figure 6:
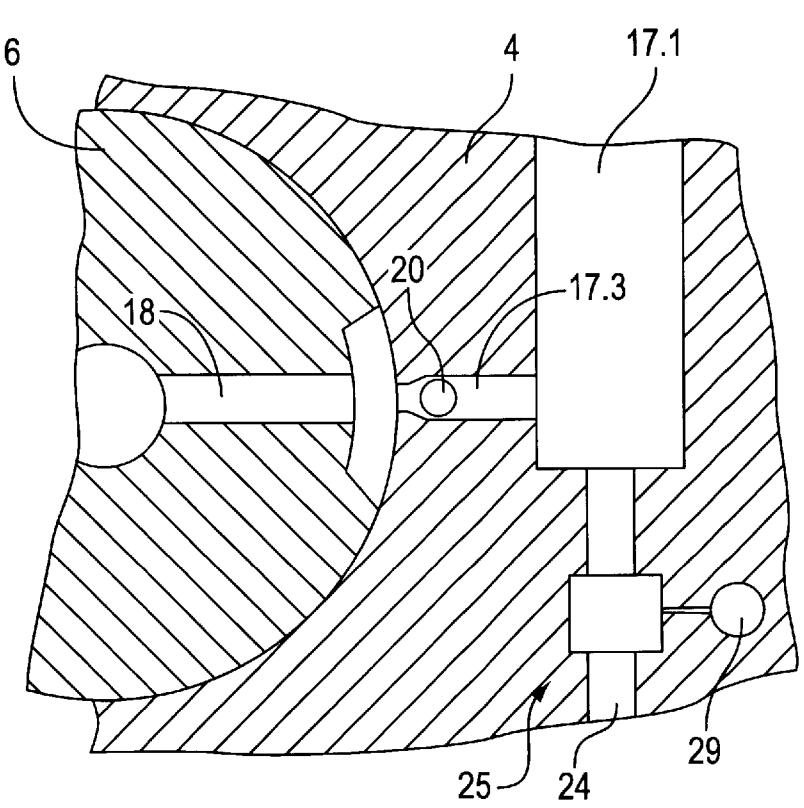
FIG. 6 A further modification of the embodiment according to FIG. 4.

FIG. 6 illustrates a modification of the embodiment according to FIG. 5. For this modification, the force-controlled valve 25 is connected to an adjustment drive 29 that can be actuated separately, e.g. an electromagnetic adjustment drive, so that the force-controlled valve 25 can be actuated via a central control unit.

Figure 7:
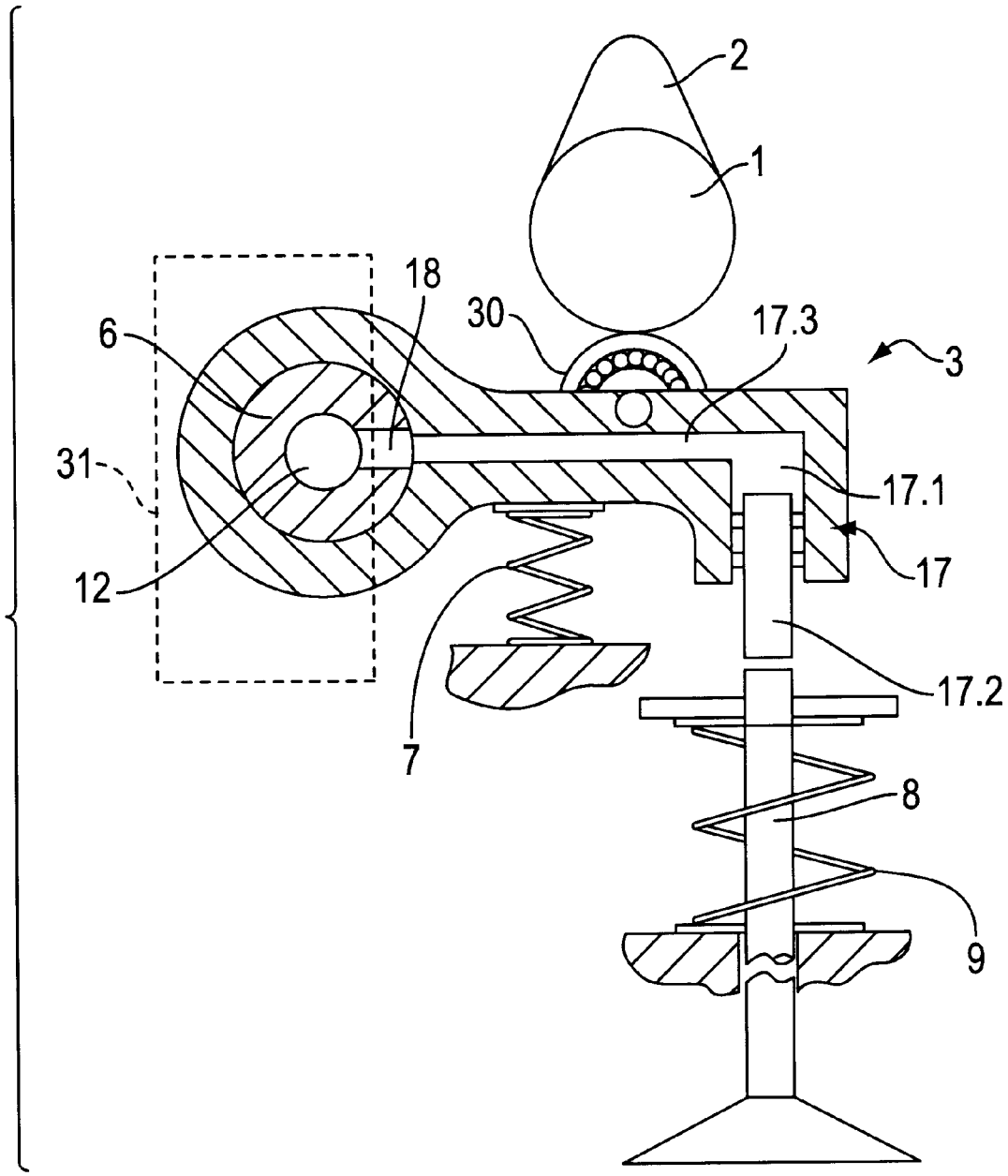
FIG. 7 A one-piece cam lever arrangement.

FIG. 7 shows a variation of the two-part cam lever arrangement described on the basis of FIG. 3. The lever arrangement 3 in this variation comprises only a one-part cam lever, which acts upon the shaft 8 of the valve to be actuated, which in turn is held in the closed position via the valve spring 9. The camshaft 1 with its radial cam 2 in this case acts upon the cam lever 3 that is positioned pivotally on the control shaft 6, which itself is positioned pivotally relative to the cam lever 3 and in turn is connected to an actuator 31 shown schematically.

The cam lever 3 supports itself on the guide surface of the radial cam 2, via an in-line arranged roller bearing 30 and is held against the guide surface of the radial cam 2 by the support spring 7.

This embodiment also provides for a hydraulic adjustment means 17 for changing the idle stroke of cam lever 3. The adjustment means 17 essentially comprises a pressure cylinder 17.1 as well as a piston-shaped transmission element 17.2, which moves therein, the free end of which acts upon the end of the shaft 8 of the valve to be actuated and supports itself on this end.

The pressure cylinder 17.1 is connected via the feed channel 17.3 in cam lever 3 to the cross bore 18 in the control shaft 6, which in turn is connected to the pressure medium channel 12 for the lubricant supply. The mouth of the feed channel 17.3 in the transition region to cross bore 18 is provided with a respective seal, as shown in FIG. 2, or with the control valves, described on the basis of FIGS. 4, 5 and 6. The operation of hydraulic adjustment means 17 corresponds otherwise to the operation of the embodiments described on the basis of FIGS. 2, 3, 4, 5 and 6.

What is claimed is:

1. Means for actuating valves of a reciprocating engine including a reciprocating internal combustion engine, comprising:

a lever arrangement having a cam lever and having an adjustment means for adjusting an idle stroke in relation to the valves;

a control shaft on which the cam lever is positioned and which can be turned back and forth relative to the lever arrangement so that the adjustment means is actuated;

at least one camshaft each having a respective cam which acts upon the lever arrangement to actuate at least one valve, wherein the cam lever is positioned pivotally on the control shaft, in contact with at least one cam on one side thereof, and in contact with the at least one valve to be actuated on another side thereof, wherein the control shaft has a pressure medium channel for supplying a fluid medium defined therein, wherein the control shaft has a cross bore defined therein in communication with the pressure medium channel, and wherein the adjustment means is an hydraulic adjustment means comprising a pressure cylinder provided in the lever arrangement, a transmission element that moves as a piston within the pressure cylinder and acts on the valve, and a feed channel in communication with the pressure cylinder at one end thereof and connectable via the cross bore in the control shaft with the pressure medium channel by turning the control shaft.

2. The means according to claim 1, further comprising a spring-mounted support element connected to the cam lever and providing bias for the cam lever against the cam.

3. The means according to claim 1, wherein the control shaft is connected to an actuator that can be triggered so that actuation of the adjustment is controlled.

4. The means according to claim 1, wherein the transmission element is a piston-cylinder element which can be admitted with a pressure medium.

5. The means according to claim 1, wherein the lever arrangement further comprises a valve lever positioned pivotally on the control shaft and connected to the valve to be actuated, and wherein the cam lever and the valve lever are connected to each other via an adjustment means with which an idle stroke can be adjusted between the cam lever and the valve lever.

6. The means according to claim 1, further comprising a valve provided in the feed channel.

7. The means according to claim 6, wherein the pressure cylinder has a filling direction, and wherein the valve provided in the feed channel is a check valve that opens in the filling direction of the pressure cylinder.

8. The means according to claim 1, wherein the pressure cylinder further comprises a discharge channel, and wherein a valve is provided in the feed channel and in the discharge channel.

9. The means according to claim 8, wherein the valve provided in one of the feed channel or the discharge channel is a force-controlled valve.

10. The means according to claim 9, wherein the force-controlled valve is actuated by the control shaft.

11. The means according to claim 9, wherein the force-controlled valve is connected to a controllable adjustment drive.

* * * * *